US006450340B1

(12) United States Patent
Hino et al.

(10) Patent No.: US 6,450,340 B1
(45) Date of Patent: Sep. 17, 2002

(54) PACKAGING BOX OF ELECTRONIC APPARATUS

(75) Inventors: Michihiro Hino; Toshiyuki Yamauchi, both of Kanagawa (JP)

(73) Assignee: Sony Corporation, Tokyo (JP)

( * ) Notice: Subject to any disclaimer, the term of this patent is extended or adjusted under 35 U.S.C. 154(b) by 31 days.

(21) Appl. No.: 09/694,956

(22) Filed: Oct. 24, 2000

(30) Foreign Application Priority Data

Oct. 25, 1999 (JP) ..... 11-302650

(51) Int. Cl.[7] ..... B65D 85/00
(52) U.S. Cl. ..... 206/459.5; 206/320; 206/701
(58) Field of Search ..... 206/459.5, 303, 206/305, 316.1, 701, 320

(56) References Cited

U.S. PATENT DOCUMENTS

| | | | | | |
|---|---|---|---|---|---|
| 3,476,239 | A | * | 11/1969 | Jacob | 242/487.3 |
| 3,910,412 | A | * | 10/1975 | Vargo | 206/335 |
| 4,246,709 | A | * | 1/1981 | Selleslags | 40/310 |
| 4,359,157 | A | * | 11/1982 | Horstmann | 206/459.5 |
| 5,228,571 | A | * | 7/1993 | Anderson | 206/391 |
| 5,524,758 | A | * | 6/1996 | Lupul | 206/459.5 |
| 5,547,325 | A | * | 8/1996 | Tucker et al. | 206/345 |
| 5,597,384 | A | * | 1/1997 | Walker et al. | 206/459.5 |

* cited by examiner

*Primary Examiner*—David T. Fidei
(74) *Attorney, Agent, or Firm*—Frommer Lawrence & Haug LLP; William S. Frommer; Matthew K. Ryan

(57) ABSTRACT

A packing bow of electronic apparatus featured in providing a characteristic diagram showing performance of electronic apparatus to be packaged to visually appeal performance of the packaged electronic apparatus to user or the like.

10 Claims, 4 Drawing Sheets

PACKAGING BOX OF ELECTRONIC APPARATUS

BACKGROUND OF THE INVENTION

1. Field of the Invention

The present invention relates to a packaging box for packaging electronic apparatus.

2. Description of the Related Art

In recent years, upon entering the digital broadcasting age, various electronic apparatus have been proposed. For example, upon entering the digital broadcasting age represented by digital broadcasting of BS (Broadcasting Satellite) starting from 2000 A.D. and terrestrial digital broadcasting, a television receiver for receiving the broadcast, which is provided with a so-to-speak D-terminal for digital broadcasting has been on sale. The television receiver having the D-terminal is aimed at connection to a digital broadcasting receiving adaptor which is predicted to provide in and after 2000 A.D. and the D-terminal and the digital broadcasting receiving adaptor can be connected by a connecting cable for signal transmission. The connecting cable of this kind can connect the D-terminal and the digital broadcasting receiving adaptor in one touch motion such that a component video signal having high screen quality including, for example, a high vision screen quality or the like can be transmitted by a single piece of cable.

Conventionally, an AV (Audio Visual) cable such as the above-mentioned connecting cable states superiority and performance of material, structure or the like.

However, according to such a connecting cable of electronic apparatus, the superiority or the performance in material, structure or the like is not expressed as characteristic data known by a user at a glance and therefore, the user is not informed well of what of the connecting cable is superior.

Although according to a catalog or an instruction manual of the connecting cable, material and structure such as adoption of oxygen free copper having high purity and 24-karat gold plating and woven shield and the like are appealed, from the view point of what and how is superior by appealing of the material or the structure, there is no visual appeal, which is difficult to understand for the user.

Under such a situation, there is requested a connecting cable having high performance with inconsiderable connection loss. A connecting cable having sufficient performance in material and structure has already been commercialized. However, the connecting cable does not sufficiently appeal to the user.

Hence, it is an object of the present invention to provide a packaging box of electronic apparatus capable of visually appealing resolving the above-described problem and the performance of packaged electronic apparatus to the user.

SUMMARY OF THE INVENTION

According to a first aspect of the present invention, there is provided a packaging box of electronic apparatus, wherein in a packaging box for packaging electronic apparatus, there is provided a characteristic diagram showing performance of the electronic apparatus to be packaged.

According to the first aspect of the present invention, the packaging box for packaging the electronic apparatus is provided with the characteristic diagram showing the performance of the electronic apparatus to be packaged.

Thereby, the user can firmly grasp the performance of the packaged electronic apparatus by visually confirming the characteristic diagram provided at the packaging box.

According to a second aspect of the present invention, there is provided the packaging box of electronic apparatus according to the first aspect of the present invention, wherein the characteristic diagram is a characteristic graph and is provided at an outer face of the packaging box by printing.

According to a third aspect of the present invention, there is provided the packaging box of electronic apparatus according to the first aspect of the present invention, wherein the characteristic diagram is a characteristic graph and is provided at an outer face of the packaging box by pasting.

According to a fourth aspect of the present invention, there is provided the packaging box of electronic apparatus according to the first aspect of the present invention, wherein the characteristic diagram is a characteristic graph, a containing portion is provided at an outer face of the packaging box and the characteristic diagram is put into the containing portion.

According to a fifth aspect of the present invention, there is provided the packaging box of electronic apparatus according to the first aspect of the present invention, wherein the electronic apparatus is a connecting cable for signal transmission.

DETAILED DESCRIPTION OF THE PREFERRED EMBODIMENTS

A detailed explanation will be given of preferable embodiments according to the present invention in reference to the drawings as follows.

Incidentally, embodiments described below are preferable specific examples of the present invention and therefore, technically preferable various limitations are attached thereto, however, the scope of the present invention is not limited to these embodiments so far as there is no description of particularly limiting the present invention in the following explanation.

Figure 1:
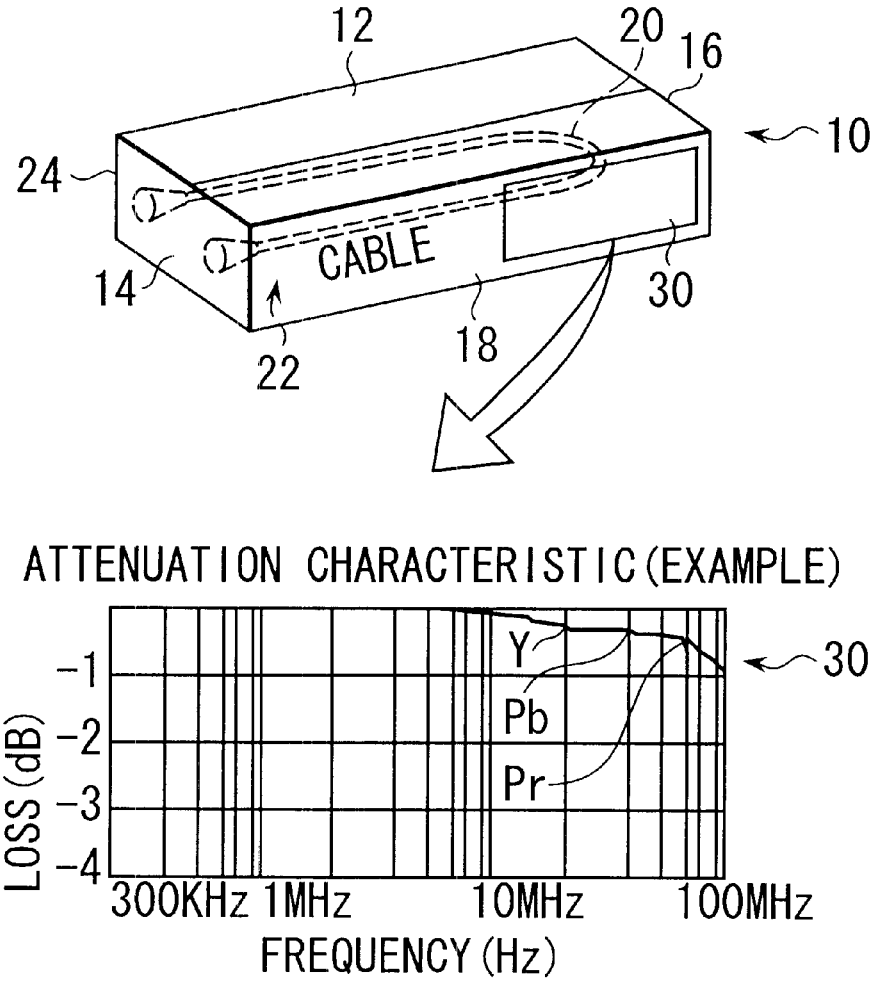
FIG. 1 is a view showing a preferable embodiment of a packaging box of electronic apparatus according to the present invention.

FIG. 1 shows a preferable embodiment of a packaging box of electronic apparatus according to the present invention.

A packaging box 10 of electronic apparatus is a container for packaging, for example, a connecting cable 20 as an electronic apparatus. The packaging box 10 of electronic apparatus is fabricated in, as an example, a rectangular parallelepiped shape by a material of kind of, for example, corrugated board, plastic, thick paper or the like.

The packaging box 10 is provided with a top portion 12, side portions 14, 16, 18 and 24 and a bottom portion 22. At the one comparatively wide side portion 18, characteristic data or characteristic graph as a characteristic diagram 30 showing performance of the cable 20, is provided by, for example, printing. According to the diagram 30, as shown by FIG. 1, for example, transmission loss (dB) of the connecting cable 20 is designated at the ordinate and frequency (Hz) is designated in the abscissa to thereby indicate so-to-speak attenuation characteristic.

In this way, by displaying the characteristic diagram 30 on an outer face of the packaging box 10 packaging the connecting cable 20 constituting an electronic apparatus by printing, the user can firmly and easily know the characteristic data of the connecting cable 20 from the characteristic diagram 30 and how the connecting cable is excellent can visually be appealed. Thereby, a discrimination of the connecting cable 20 from competitive products of other companies can be achieved and technically high performance image can be appealed. Further, performance of the connecting cable 20 can specifically be appealed to the user.

Figure 2:
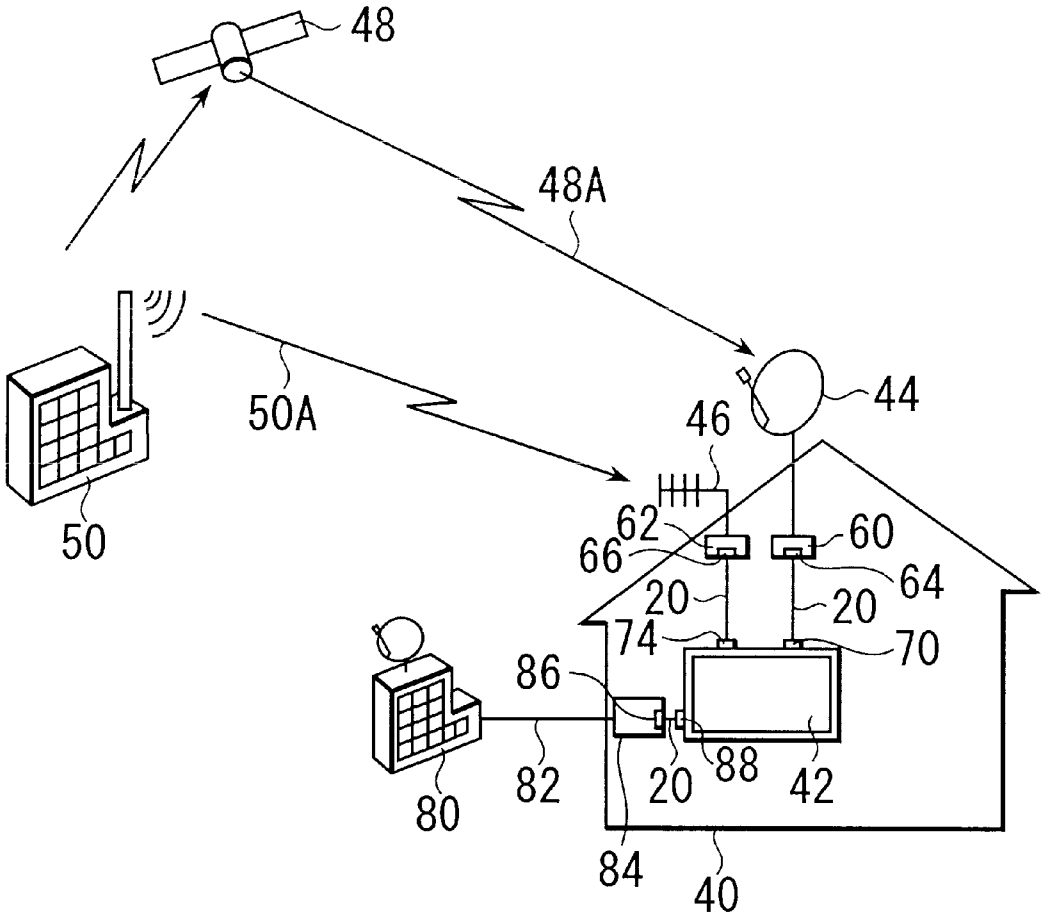
FIG. 2 is a view showing an example of applying a connecting cable as electronic apparatus contained in the packaging box of FIG. 1.

The connecting cable 20 of FIG. 1 can be used as a connecting cable applied to a digital broadcasting receiving system shown by, for example, FIG. 2.

According to the television broadcasting receiving system of FIG. 2, for example, a television receiver 42 is arranged in a house 40. The house 40 is attached with a parabola antenna 44 and other antenna 46. The parabola antenna 44 receives digital broadcasting wave 48A from a communication satellite 48. Further, the antenna 46 receives terrestrial digital broadcasting wave 50A from a terrestrial broadcasting station 50.

The parabola antenna 44 is connected to a digital broadcasting receiving adaptor 60. The antenna 46 is connected to a terrestrial digital broadcasting receiving adaptor 62. The connecting cable 20 of FIG. 1 is connected to a terminal 64 of the digital broadcasting receiving adaptor 60 and a D-terminal 70 for digital broadcasting of the television receiver 42.

Similarly, the other connecting cable 20 is connected between a terminal 66 of the terrestrial digital broadcasting receiving adaptor 62 on the side of the antenna 46 and a D-terminal 74 of the television receiver 42.

Further, a CATV (Cable Television) station 80 is connected to a digital broadcasting receiving adaptor 84 via a cable 82. Still other connecting cable 20 is connected between a terminal 86 of the digital broadcasting receiving adaptor 84 and a D-terminal 88 of the television receiver 42.

For example, when the digital broadcasting wave 48A is received by the parabola antenna 44, the digital broadcasting receiving adaptor 60 carries out predetermined signal processing.

Further, the connecting cable 20 can display received video of digital broadcasting by transmitting a signal from the digital broadcasting receiving adaptor 60 to the television receiver 42 via the D-terminal 70.

Similarly, when the terrestrial digital broadcasting wave 50A is received by the antenna 46, the terrestrial digital broadcasting receiving adaptor 62 carries out predetermined signal processing.

Thereby, the connecting cable 20 can transmit a signal from the terrestrial digital broadcasting receiving adaptor 62 to the television receiver 42 via the D-terminal 74 and the television receiver 42 can display received video of the terrestrial digital broadcasting wave.

Or, a signal from the CATV station 80 is subjected to predetermined signal processing by the digital broadcasting receiving adapter 84 via the cable 82.

Thereby, the connecting cable 20 can display video by transmitting a signal from the digital broadcasting receiving adaptor 84 to the television receiver 42 via the D-terminal 88.

Figure 3:
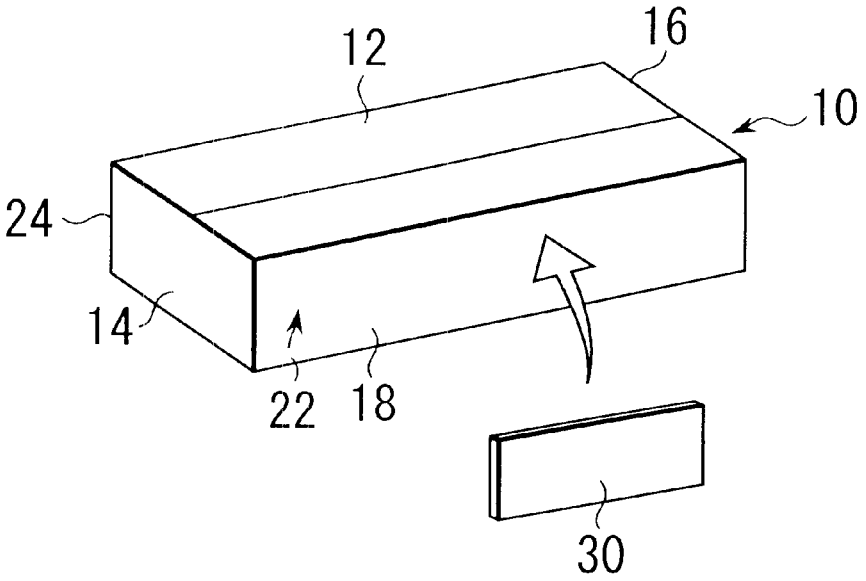
FIG. 3 is a view showing other embodiment of a packaging box of electronic apparatus according to the present invention.

Next, an explanation will be given of other embodiment of a packaging box of electronic apparatus according to the present invention in reference to FIG. 3.

Although the packaging box 10 of electronic apparatus is similar to the packaging box 10 of FIG. 1, the characteristic diagram 30 is provided by, for example, pasting the characteristic diagram 30 on the side portion 18 by using an adhering agent. By pasting the characteristic diagram 30 later on the packaging box 10 in this way, in comparison with the case of printing, the case of other kind of electronic apparatus contained in the packaging box 10 can simply be dealt with.

Figure 4:
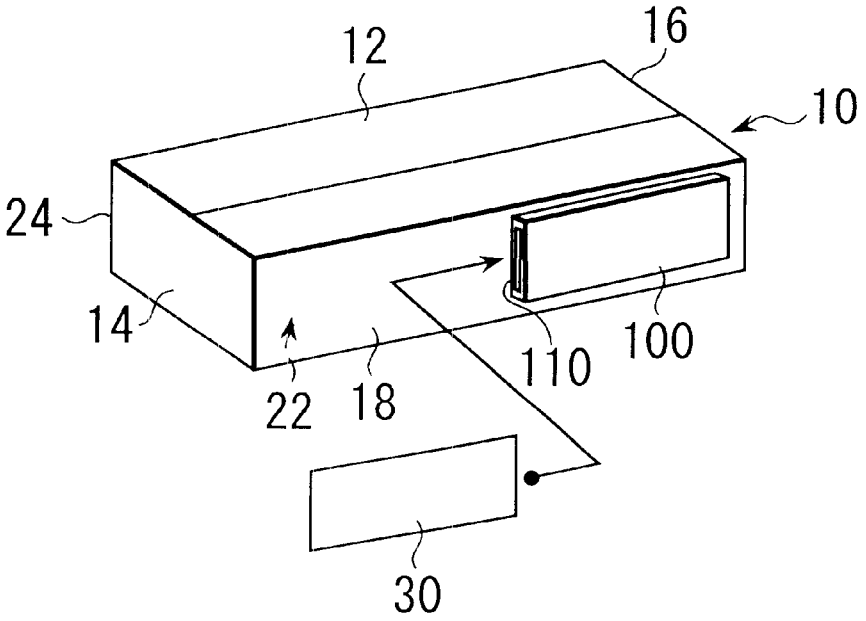
FIG. 4 is a view showing still other embodiment of a packaging box of electronic apparatus according to the present invention.

FIG. 4 shows still other embodiment of a packaging box of electronic apparatus according to the present invention. In the example of the packaging box 10 of FIG. 4, a containing portion 100 is previously fixed to the side portion 18. The containing portion 100 can be fabricated by, for example, transparent plastic. An opening portion 110 of the containing portion 100 can be inserted with the characteristic diagram 30 attachably and detachably. The characteristic diagram 30 contained in the containing portion 100 can firmly be seen through the containing portion 100.

By adopting such a structure, even in the case in which electronic apparatus intended to contain in the packaging box 10 is replaced by other one, display can be changed immediately and firmly in correspondence therewith.

Figure 5:
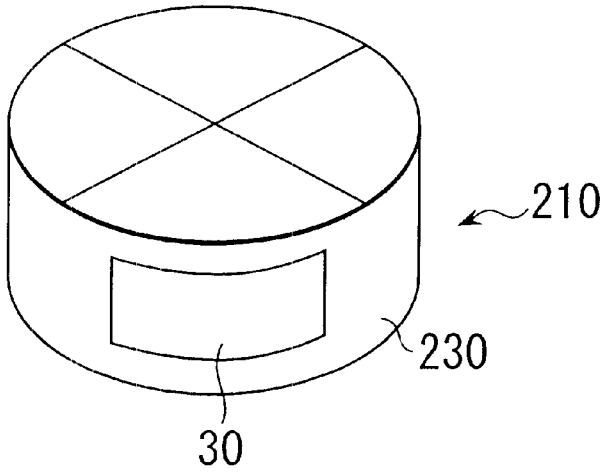
FIG. 5 is a view showing still other embodiment of a packaging box of electronic apparatus according to the present invention.

FIG. 5 shows still other embodiment of a packaging box of electronic apparatus according to the present invention. The packaging box 210 is of, for example, a circular cylindrical shape and the characteristic diagram 30 is provided at a surrounding face 230 thereof. Naturally, the characteristic diagram 30 may be provided by, for example, printing or may be pasted thereon by an adhering agent. Or, naturally, as shown by FIG. 4, a containing portion may be provided and the characteristic diagram 30 may be contained therein attachably and detachably.

Figure 6:
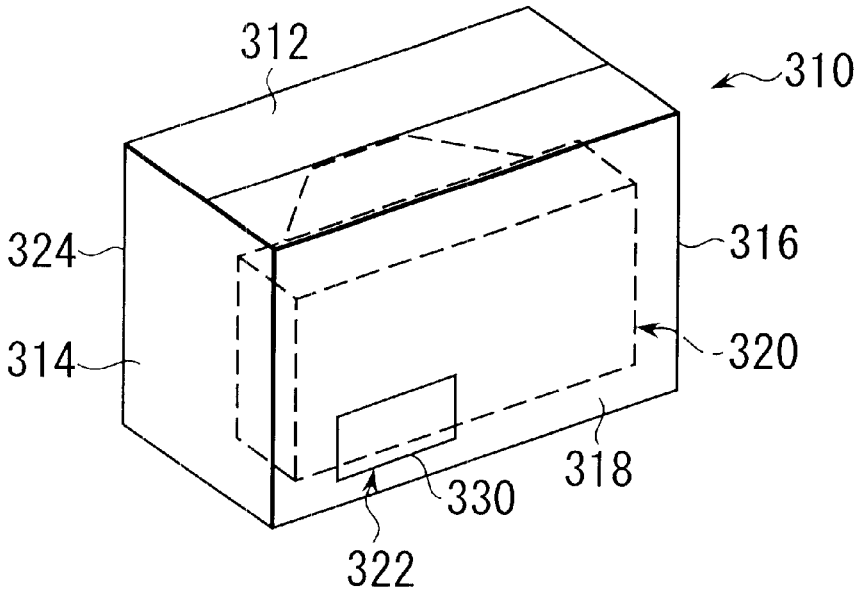
FIG. 6 is a view showing still other embodiment of a packaging box of electronic apparatus according to the present invention.

FIG. 6 shows still other embodiment of a packaging box of electronic apparatus according to the present invention. A packaging box 310 is a box having a top portion 312, a bottom portion 322 and side portions 314, 316, 318 and 324. In the packaging box 310, as other electronic apparatus, a television receiver 320 is contained. At the side portion 318 of the packaging box 310, a characteristic diagram 330 is provided by, for example, printing. The characteristic diagram 330 may not be provided by printing but may be pasted by an adhering agent, or, naturally, there may be constituted a structure in which a containing portion is provided as shown by FIG. 4 and the characteristic diagram 330 may be contained in the containing portion attachably and detachably.

By displaying characteristic of the television receiver 320, for example, power conservation characteristic or other characteristic in the characteristic diagram 330, the user can visually grasp the feature of the television receiver 320.

As has been explained above, according to the packaging box of electronic apparatus of the present invention, by providing a characteristic diagram such as a characteristic graph of electronic apparatus which is intended to package on an outer face of the packaging box which is referred to as individual packaging carton by printing, pasting or in other system, the user can firmly grasp visually the characteristic of the electronic apparatus.

In the future, with start of digital broadcasting, the AV (Audio Visual) cable conveys highly fine video signal. In compliance therewith, excellent frequency characteristic of the cable per se is requested and therefore, a characteristic graph is printed on an individual packaging carton such that a user can know the characteristic at a glance.

A discrimination between electronic apparatus contained in the packaging box and competitive products of other companies can be carried out. Technically high performance image can be appealed and image of something great is given by only attaching the characteristic graph even when the characteristic graph may not be known technically.

Performance can be appealed specifically to the user. For a user having more or less knowledge, the frequency characteristic provides a general method in view of evaluating the performance.

Meanwhile, the present invention is not limited to the above-described embodiments, the shape of the packaging box is not limited to the illustrated shapes but other shape can naturally be adopted. Further, as the kinds of electronic apparatus to be contained, there are included not only the connecting cable or the television receiver but also other kind of electronic apparatus, for example, a monitor apparatus of a computer, a recording/reproducing apparatus or a reproducing apparatus of an information recording medium on a disk, a stereo head phone, a stereo earphone, a game machine and so on.

Further, the characteristic diagram is not limited to the characteristic graph but a characteristic diagram of a display system of other mode is naturally included.

As has been explained, according to the present invention, performance of packaged electronic apparatus can visually be appealed to the user.

What is claimed is:

1. A packaging box in which a connection cable is packaged comprising a characteristic diagram provided on an outer face thereof showing performance of the connection cable whereby transmission loss of the connecting cable is designated at an ordinate position of the diagram and frequency of the connection cable is designated in an abscissa position to thereby indicate the attenuation characteristic of the connection cable.

2. The packaging box according to claim 1, wherein the packaging box is formed at least in part of corrugated board.

3. The packaging box according to claim 1, wherein the packaging box is formed at least in part of plastic.

4. The packaging box according to claim 1, wherein the packaging box is in a shape of a parallelepiped rectangle.

5. The packaging box according to claim 1, wherein the packaging box is in a shape of a circular cylinder.

6. The packaging box according to claim 1, wherein the characteristic diagram is a characteristic graph and is printed at an outer face of the packaging box.

7. The packaging box according to claim 1, wherein the characteristic diagram is a characteristic graph which is pasted to an outer face of the packaging box.

8. The packaging box according to claim 1, wherein the characteristic diagram is a characteristic graph and a containing portion is provided at an outer face of the packaging box into which the characteristic diagram is inserted and stored.

9. The packaging box according to claim 1, wherein the connection cable is used for signal transmission.

10. The packaging box according to claim 1, wherein the connection cable is used in conjunction with a television receiver.

* * * * *